United States Patent [19]

Inderbitzen

[11] Patent Number: 4,461,110

[45] Date of Patent: Jul. 24, 1984

[54] SAFETY LATCH ARRANGEMENT FOR USE IN A FIREARM

[75] Inventor: Daniel T. Inderbitzen, 1801 Ashley Ct., Modesto, Calif. 95351

[73] Assignee: Daniel T. Inderbitzen, Modesto, Calif.

[21] Appl. No.: 364,399

[22] Filed: Apr. 1, 1982

[51] Int. Cl.[3] ..... F41C 17/00

[52] U.S. Cl. ..... 42/66; 42/70 F

[58] Field of Search ..... 42/66, 70 F, 70 R

[56] References Cited

U.S. PATENT DOCUMENTS

| | | | |
|---|---|---|---|
| 311,323 | 1/1885 | Hopkins | 42/66 |
| 792,381 | 6/1905 | Allen | 42/70 |
| 795,816 | 8/1905 | Bye | 42/66 |
| 2,703,943 | 3/1955 | Roemer | 42/70 |
| 2,863,249 | 12/1958 | Koucky et al. | 42/66 |
| 3,296,729 | 1/1967 | Stevens, Jr. | 42/66 |
| 3,624,947 | 12/1971 | Worrall, Sr. | 42/66 |
| 3,626,622 | 12/1971 | Uberti | 42/66 |
| 3,626,623 | 12/1971 | Uberti | 42/66 |
| 3,838,533 | 10/1974 | Ruger | 42/66 |

*Primary Examiner*—Charles T. Jordan

*Attorney, Agent, or Firm*—Flehr, Hohbach, Test, Albritton & Herbert

[57] ABSTRACT

A firearm of the type utilizing a pivoting hammer which either carries or does not carry a firing pin is disclosed herein along with a specific safety latch for use therewith. The safety latch is carried in its entirety by the hammer behind its thumb spur and is movable in a direction perpendicular to the pivotal movement of the hammer between a first safe position and a second firing position. With the latching member in its safe position, it cooperates with the main frame of the firearm for preventing the hammer from any movement. With the latch member in its firing position, the hammer is made free.

6 Claims, 8 Drawing Figures

SAFETY LATCH ARRANGEMENT FOR USE IN A FIREARM

The present invention relates generally to firearms of the type utilizing spring loaded hammers which either carry or do not carry firing pins and more particularly to a hammer actuated firearm including a safety latch arrangement which is carried by its hammer and which is designed to take at most a minimum amount of physical abuse during normal operation of the firearm while, at the same time, providing a reliable safety mechanism.

The typical hammer actuated revolver type firearm utilizes a cylinder, a main frame providing an opening into the cylinder and, of course, a hammer. The latter includes a hammer body either carrying or not carrying a firing pin at its front end and a thumb spur which is disposed behind the firing pin and which extends upwardly and rearwardly therefrom above the base of the hammer body. The hammer is supported in a spring loaded fashion at its base for pivotal movement into and out of the frame opening so as to move the firing pin into the cylinder with a relatively large amount of force.

In order to prevent a firearm of this type from accidentally firing, it is necessary to prevent the firing pin from moving into the cylinder and making contact with the bullet primer. One way to accomplish this is to provide a latching mechanism in the main frame of the firearm as seen for example in U.S. Pat. Nos. 311,323 and 1,227,531. In each of these cases, the mechanism is slidable laterally within its main frame so as to either interlock with the firearm's hammer or allow the latter to move freely. In accordance with another approach, specifically U.S. Pat. No. 3,624,947, the latching mechanism is carried by the hammer itself. This mechanism is one which is mounted for rotation at the head of the hammer just above its firing pin. When the latching mechanism is placed in its "safe" position, it slams against the frame of the firearm so as to prevent the firing pin from entering the firing chamber. When this mechanism is in its firing position, it still slams against the firearm frame but does so only after the tip of the firing pin enters the firing chamber.

While applicant has found that it is preferable to carry the latching mechanism on the hammer rather than in the main frame of the firearm, he has observed serious disadvantages to the technique utilized in U.S. Pat. No. 3,624,947. First, because of its position on the hammer, the latching mechanism described in this patent is subject to substantial abuse during normal operation of the firearm. More specifically, each time the trigger is pulled, the latching mechanism is caused to slam into the main frame of the firearm whether or not the latching member is in its safe or firing position. Since this particular latching mechanism is comprised of a number of components which must move relative to one another, abuse of the type just recited often results in misalignment problems and fractured or bent components. A second disadvantage to the latching mechanism in the '947 patent also results from its position on the hammer. Specifically, because it is at the top front end thereof, it is relatively difficult for the user to manipulate with his fingers while handling the firearm in the appropriate manner.

In view of the foregoing, it is one object of the present invention to provide the hammer actuated firearm including a safety latch arrangement carried by its hammer but without subjecting the mechanism to the physical abuse recited above.

Another object of the present invention is to provide a hammer actuated firearm of the type just recited and specifically one having a hammer carried latching mechanism which is located so as to be easily and quickly moved between its latched and unlatched positions by the thumb of the individual handling the firearm.

As will be disclosed in more detail hereinafter, the firearm disclosed herein is of the type having a cylinder, a main frame providing an opening into the cylinder, and a hammer including a hammer body carrying a firing pin at its front end and a thumb spur which is disposed behind the pin and which extends upwardly and rearwardly therefrom above the base of the hammer body. In addition, means are provided for supporting the hammer in a spring loaded manner at its base for pivotal movement into and out of the frame opening so as to cause the firing pin to slam into the cylinder during normal use of the firearm.

In accordance with the present invention, the firearm just briefly described also includes a safety latch arrangement including latching means carried by the hammer body between its base and thumb spur behind the latter for movement between first and second positions. In its first position, the latching means moves with the hammer to recess into the frame to a cocked position. The gun is fired from that position by the trigger being pulled. This allows the hammer to drop, causing the firing pin to strike against the bullet primer, firing the gun. In its second position the latching means engages the main frame to prevent the hammer from recessing into the frame and achieving a cocked position, simply freezing the hammer from any rearward movement or forward movement.

The overall firearm recited above and particularly its safety latch arrangement will be described in more detail in conjunction with the drawing wherein.

Figure 1:
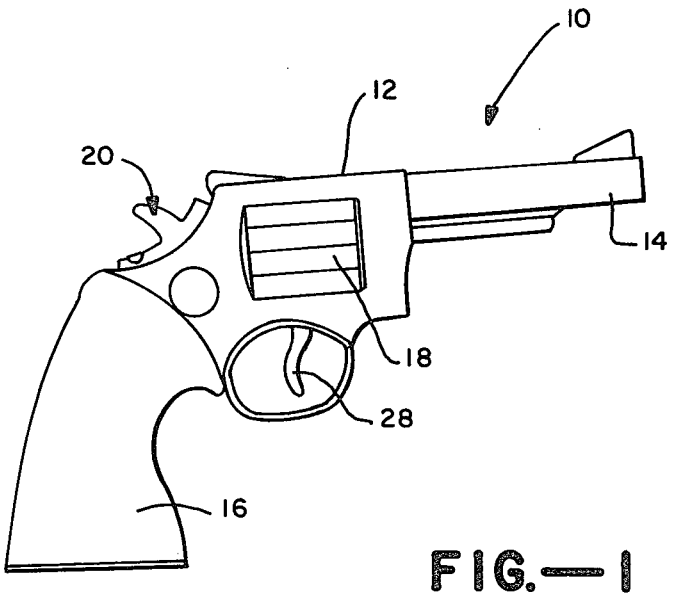
FIG. 1 is a side elevational view of a hammer actuated revolver or handgun including a safety latch arrangement designed in accordance with the present invention, the revolver or gun being shown in its unlatched or firing condition.

Turning now to the drawings, wherein like components are designated by like reference numerals throughout the figures, attention is first directed to FIG. 1 which illustrates a revolver or handgun 10 generally indicated by the reference numeral 10. This handgun includes a main frame 12 supporting a barrel 14 at its front end and a back strap or handgrip 16 at its back end. The main frame itself which is at least partially hollow carries a cylinder 18 or other suitable means for providing a firing chamber and defines an opening 19 therein and (see FIG. 2) into the firing chamber behind barrel 14.

Figure 3:
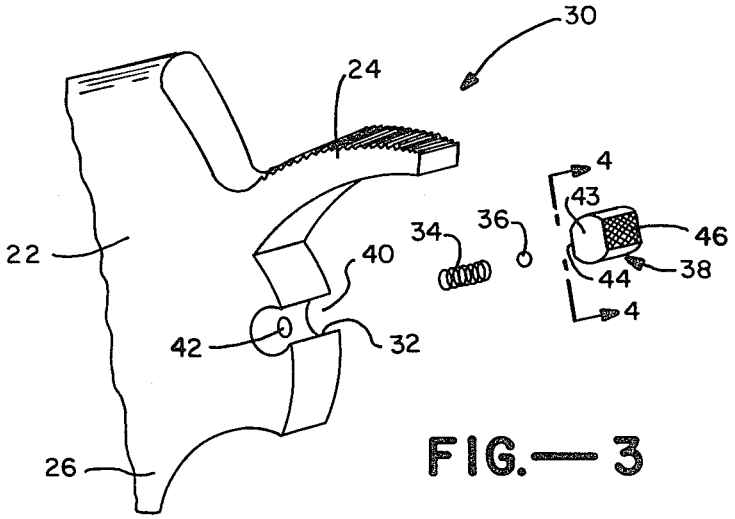
FIG. 3 is an exploded perspective view illustrating the various components making up the safety latch arrangement forming part of the revolver or gun illustrated in FIG. 1.

The gun 10 also includes a hammer 20 which is comprised of a hammer body 22 carrying a firing pin (not shown) at its front end and a thumb spur 24 which is disposed behind the firing pin and which extends upwardly and rearwardly therefrom above the base 26 of the hammer body, as best illustrated in FIG. 3. While not shown, gun 10 includes suitable means (typically within the handgrip) for supporting hammer 20 to main frame 12 in a spring loaded manner at its base for pivotal movement into and out of the frame opening 19 so as to cause the hammer to recess into the frame opening to a cocked position and eventually attain an ignition of the bullet primer by the firing pin when the hammer drops or is released to fall. A trigger 28 disposed within a trigger guard carried by the main frame is provided for actuating the hammer 20 and thereby causing the firing pin to first draw back and then slam into the cylinder.

The various components making up handgun 10 thus far described are conventional or readily providable and hence will not be discussed in detail herein except in relation to the present invention which provides for a safety latch arrangement forming part of the gun. This arrangement is generally indicated by the reference numeral 30 and is shown best in FIGS. 3–8. As seen best in FIG. 3, arrangement 30 is comprised of a channel 32, a spring member 34, a ball bearing 36 and a latching member 38. As will be seen below, these components cooperate with one another to either allow the hammer to operate in its normal firing fashion or to prevent the hammer from recessing into the frame to attain a cocked position thereby preventing the gun from firing.

Figure 5:
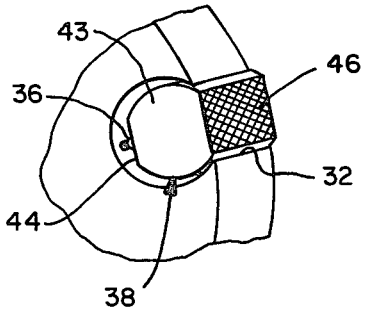
FIG. 5 is a side perspective view of the latching arrangement of FIG. 3 but in an assembled fashion.

As seen best in FIGS. 3 and 5, channel 32 is located in hammer body 22 directly behind and under thumb spur 24 and extends normal to the movement of the hammer, that is, normal to the length of thumb spur 24. For reasons to be discussed below, channel 32 is somewhat C-shaped in cross-section so as to define a slot 40 which opens into the channel and which faces outwardly and upwardly in the general direction of the thumb spur. A blind hole 42 is provided in the bottom of channel 32 generally centrally between the ends of the latter and serves to receive and hold a bottom segment of spring member 34 as best illustrated in FIG. 5. The top end of the spring member is adapted to receive and hold a segment of bearing 36, as best illustrated in FIG. 6.

Figure 2:
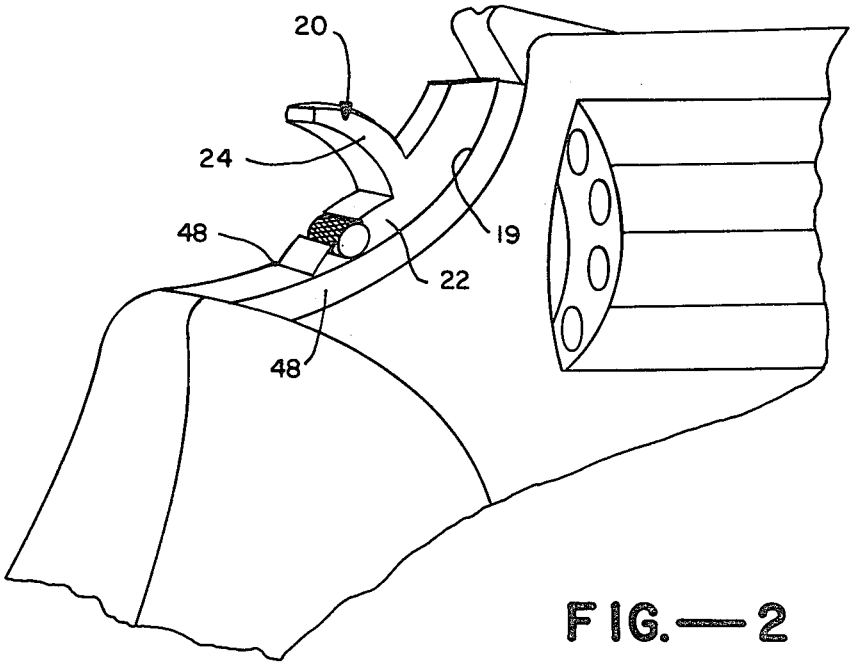
FIG. 2 is an enlarged perspective view of a portion of the revolver illustrated in FIG. 1 and specifically illustrating its safety latch arrangement in a safe or latched condition.

Referring specifically to latching member 38, the latter is shown including a main body 43 which is somewhat C-shaped in cross-section (see FIG. 5), although it includes a substantially flat back end 44. Its front end is also flat so as to define a roughened thumb actuating surface 46. As best seen in FIG. 5, latching member 38 is configured to fit slidably within channel 32 such that its flat back end is in confronting relationship with blind hole 42 and its thumb actuating surface 46 either extends slightly out of or is otherwise readily accessible through slot 40. Because of the C-shaped configuration of the channel, the latching member cannot be pulled out through its slot. At the same time, most of the channel depth and most of body 43 are disposed within main frame 12, that is, below the sections of main frame 12 indicated at 48 in FIG. 2 (also see FIGS. 7 and 8). In this way, the latching member is prevented from sliding out from either end of the channel. On the other hand, as best illustrated in FIG. 6, the body 43 of latching member 38 includes a top end segment 50 which extends out beyond the rest of the body so as to define a stepped shoulder 52. As best seen in FIG. 2, segment 50 is disposed above frame sections 48 so as to be movable beyond the latter while stepped shoulder 52 remains below the frame. As a result, the entire latching member is movable along the length of channel 40 between a first position such that its entire body is within the channel and a second position such that segment 50 extended out beyond one end of the channel, specifically the right-hand end as viewed in FIGS. 1 and 2 in the embodiment shown. This restricts rearward or forward movement of the hammer.

Figure 4:
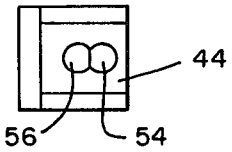
FIG. 4 is a bottom plan view of a latching member forming part of the arrangement illustrated in FIG. 3, taken generally along line 4—4 in FIG. 3.
Figure 6:
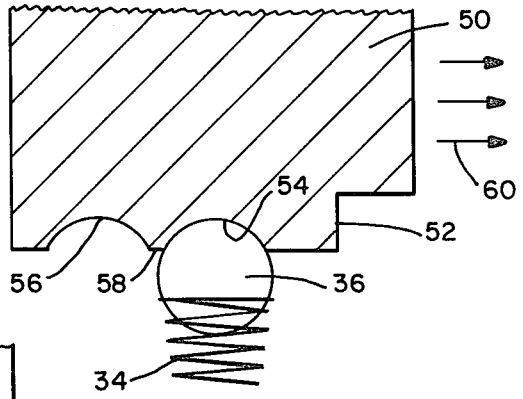
FIG. 6 is a back elevational view of the latching mechanism forming part of the overall latch arrangement and cooperating components also forming part of this arrangement.
Figure 7:
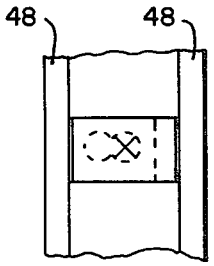
FIGS. 7 and 8 diagrammatically illustrate how the latching arrangement of FIGS. 3–6 operates between a latched position and an unlatched position.
Figure 8:
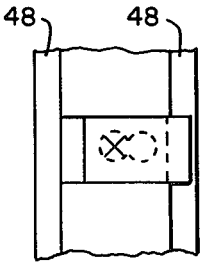

Referring specifically to FIGS. 4 and 6, the bottom 44 of latching member 38 is shown including a pair of adjacent indents 54 and 56 which are somewhat hemispherical in configuration and which define a partial ridge 58 between the two. Each of these indents is specifically configured to receive the otherwise exposed portion of bearing 36. The bearing is shown in FIG. 6 disposed within indent 54 and it is shown in the same position diagrammatically in FIG. 7 (e.g. by means of the X). With the bearing in indent 54, the entire latch member including segment 50 is disposed within the confines of channel 32, thereby allowing hammer 20 to function in its normal manner for allowing the gun to fire. Through the urging of spring 34, the ball bearing 36 maintains the latching member in this position. However, the gun may be prevented from firing by manually sliding the latching member along channel 32 in the direction of arrows 60 illustrated in FIG. 6. This can be readily accomplished by the operator's thumb and places the bearing 36 in indent 56 as illustrated diagrammatically in FIG. 8 At the same time, segment 50 is disposed beyond channel 32 over one of the frame segments 48. In this way, segment 50 cooperates with frame section 48 for preventing the hammer from recessing into the frame to a cocked position, thus preventing the gun from firing.

From the foregoing, it should be apparent that an individual operating handgun 10 can readily manually move latching member 38 between its latched and unlatched positions with nothing more than the manipulation of his thumb. This can be done easily by either a right-handed person or a left-handed person. It should also be apparent that the latching member and its other components making up the overall latching arrangement are carried entirely by the hammer. When the latching member is in its unlatched position, none of these components are directly contacted by any of the other components of the gun as the hammer is actuated. In other words, the latching arrangement does not slam into the main frame (or any other component). This is to be contrasted with the latching mechanism in the U.S. Pat. No. 3,624,947 patent where the latching mechanism is slammed against the frame of its firearm whether or not the latching mechanism is in a latched or unlatched position. In addition, when latching member 38 is in its latched position, the hammer is blocked from recessing into the frame. This is accomplished by segment 50 striking against frame section 48 when the trigger is pulled. This simply freezes the hammer from movement and because of the internal structure of the revolver it freezes the entire mechanism. For these reasons, the overall latching arrangement 30 is subjected to relatively little physical abuse during normal operation of the gun whether the latter is in a safe or firing state.

While latching arrangement 30 has been described with regard to handgun 10, it is to be understood that the latching arrangement is equally applicable with other types of hammer actuated firearms, when the hammer is similar in design, whether or not the hammer carries a firing pin. It is also to be understood that the latching member 38 can be made to slide laterally to either the right or left, which would entail building segment 50 on the respective side preferred.

I claim:

1. A safety latch arrangement for use in a firearm of the type including a cylinder adapted to contain a bullet having a primer, a main frame which is at least partially hollow and which provides an opening therein and into said cylinder, a trigger, a hammer including a hammer body carrying firing pin means at its front end and a thumb spur which is disposed behind the pin means and which extends upwardly and rearwardly therefrom above the base of the hammer body, and means for supporting said hammer in a spring loaded manner for pivotal movement rearwardly into and forwardly out of said frame opening about a pivot axis at the base of the hammer so as to cock the hammer in a rearward, recessed position in said frame such that the hammer can be released by way of the trigger, the falling of the hammer forcing the firing pin means through the frame opening and into the cylinder to make contact with the bullet's primer, said safety latch arrangement comprising latching means carried by said hammer body within a channel located within said hammer body between its base and thumb spur, behind the latter, for movement with the hammer as the latter pivots back and forth about said axis, said latching means being movable within said channel between a first position which cooperates with said main frame for preventing the hammer from rearwardly recessing into the frame through said opening and a second position which allows the hammer to rearwardly recess into the frame through said opening whereby to be moved to allow a cocked position and thereby capable of firing the firearm, said channel extending perpendicular to the movement of said hammer and opening outward behind and in the direction of said thumb spur for providing a slot, said latch means including a top segment which is made accessible by said slot, whereby an individual can readily manually move the latch member between its first and second positions.

2. An arrangement according to claim 1 wherein said latching means is supported in its entirety by said hammer body so as not to engage any other component as the hammer pivots back and forth when the latching means is in its second position.

3. An arrangement according to claim 2 wherein said latching means is substantially closer to the base of said hammer body than to the firing pin means whereby it moves along a substantially shorter path of movement than the firing pin means as the hammer pivots above said axis.

4. A safety latch arrangement for use in a firearm of the type including a cylinder, a main frame which is at least partially hollow and which provides an opening therein and into said cylinder, a hammer including a hammer body carrying firing pin means at its front end and a thumb spur which is disposed behind the pin means and which extends upwardly and rearwardly therefrom above the base of the hammer body, and means for supporting said hammer in a spring loaded manner at its base for pivotal movement rearwardly into and forwardly out of the frame opening so as to allow free movement of the hammer, said arrangement comprising: a channel in said hammer body extending perpendicular to the movement of said hammer and opening outward behind and in the direction of said thumb spur; a latch member disposed within said channel and movable therein between a first hammer locking position such that a portion of the member extends outside the channel for engagement with said main frame whereby to prevent said hammer from moving rearwardly into the frame to reach a cocked position and a second firing position substantially entirely within said channel whereby to allow the hammer to move freely in order to cause said firing pin means to eventually slam into its firing position; and means for releasably supporting said latch member in either said hammer locking or firing position, said latch member including a top segment which is made accessible by said slot, whereby an individual can readily manually move the latch member between its locking position and its firing position.

5. An arrangement according to claim 4 wherein said channel and said latch member are located behind and near the base of said thumb spur.

6. A safety latch arrangement for use in a firearm of the type including a cylinder, a main frame which is at least partially hollow and which provides an opening therein and into said cylinder, a hammer including a hammer body carrying firing pin means at its front end and a thumb spur which is disposed behind the pin means and which extends upwardly and rearwardly therefrom above the base of the hammer body, and means for supporting said hammer in a spring loaded manner at its base for pivotal movement rearwardly into and forwardly out of the frame opening so as to allow free movement of the hammer, said arrangement comprising: a channel in said hammer body located behind and near the base of said thumb spur and extending perpendicular to the movement of said hammer; a latch member disposed within said channel and movable therein between a first hammer locking position such that a portion of the member extends outside the channel for engagement with said main frame whereby to prevent said hammer from moving rearwardly into the frame to reach a cocked position and a second firing position substantially entirely within said channel whereby to allow the hammer to move freely in order to cause said firing pin means to eventually slam into its firing position; and means for releasably supporting said latch member in either said hammer locking or firing position, said supporting means including a hole in the bottom of said channel, a spring disposed partially within and extending partially out of said hole, a ball bearing supported on the free end of said spring, and a pair of adjacent hemispherical indents in said latch member for alternatively containing a portion of said ball bearing as the latter is urged therein by said spring, whereby to releasably support the latch member, said channel opening outward behind and in the direction of said thumb spur for providing a slot and said latch member including a top segment which is made accessible by said slot, whereby an individual can readily manually move the latch member between its locking position and its firing position.

* * * * *